US007158648B2

(12) United States Patent
Butters et al.

(10) Patent No.: US 7,158,648 B2
(45) Date of Patent: Jan. 2, 2007

(54) LOUDSPEAKER SYSTEM WITH EXTENDED BASS RESPONSE

(75) Inventors: Aaron L. Butters, Thousand Oaks, CA (US); Sargam Patel, West Hollywood, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 478 days.

(21) Appl. No.: 10/621,088

(22) Filed: Jul. 15, 2003

(65) Prior Publication Data

US 2004/0105565 A1 Jun. 3, 2004

Related U.S. Application Data

(60) Provisional application No. 60/400,271, filed on Jul. 30, 2002.

(51) Int. Cl.
*H04R 7/16* (2006.01)

(52) U.S. Cl. ..... 381/160; 181/163

(58) Field of Classification Search ..... 381/160, 381/337, 349, 352, 186, 184, 156, 152, 165, 381/163, 144

See application file for complete search history.

(56) References Cited

U.S. PATENT DOCUMENTS

| | | | | |
|---|---|---|---|---|
| 4,207,963 | A | 6/1980 | Klasco | |
| 4,379,951 | A * | 4/1983 | Gabr | 381/431 |
| 5,432,860 | A * | 7/1995 | Kasajima et al. | 381/349 |
| 6,044,925 | A | 4/2000 | Sahyoun | |

OTHER PUBLICATIONS

Color images of a device from Technics taken at the Southern California DIY Audio Meeting in Claremont, California by Charles Sprinkle on Jul. 28, 2002, 4 pages.

* cited by examiner

*Primary Examiner*—Sinh Tran
*Assistant Examiner*—Walter F Briney, III
(74) *Attorney, Agent, or Firm*—Brinks Hofer Gilson & Lione

(57) ABSTRACT

A loudspeaker system has an extended bass or low frequency response. The loudspeaker system integrates a passive radiator with a transducer. The loudspeaker system also mechanically isolates the passive radiator and the transducer. A support mechanism mechanically grounds vibrations or other forces from the transducer and passive radiator that may interfere or affect the operation of the loudspeaker.

60 Claims, 5 Drawing Sheets

LOUDSPEAKER SYSTEM WITH EXTENDED BASS RESPONSE

CROSS REFERENCE TO RELATED APPLICATIONS

This application claims priority to Provisional Application Ser. No. 60/400,271 entitled "PASSIVE RADIATOR" filed on Jul. 30, 2002, which is incorporated by reference in its entirety.

BACKGROUND OF THE INVENTION

1. Technical Field

This invention relates to loudspeaker systems having a transducer with a bass-reflex device. More particularly, this invention relates to loudspeaker systems having a passive radiator to extend the low frequency response of the transducer.

2. Related Art

Loudspeakers or speakers transform electrical signals into acoustical energy. Many loudspeakers have a transducer, sometimes referred to as an active driver, a driver, or a direct radiator, mounted in a speaker enclosure. The speaker enclosure may have a box-like configuration with sides and a back enclosing the transducer. The speaker enclosure may have other shapes and configurations including those that conform to environmental conditions of the loudspeaker location, such as in a vehicle. The transducer may provide a full range of acoustical frequencies from low to high. The transducer may provide a particular range of acoustical frequencies, such as low frequencies and/or midrange frequencies. Many loudspeakers have multiple transducers and/or a combination of transducers in the speaker enclosure. When multiple transducers are utilized in the speaker enclosure, it is common for individual transducers to operate in different frequency bands.

A transducer generally may have a cone connected along its outer perimeter to a frame by a surround. The cone may be made of paper, polymer, metal, ceramic, composites, and the like. The frame may be made of metal or other rigid material. The surround may be made of an elastomer like foam rubber, a doped cloth, or other pliable material and can contribute to isolating the cone from the frame. The cone is connected along its inner perimeter to a former, which is wrapped with insulated wire to form a voice coil. The voice coil generally is positioned within the magnetic gap of a magnetic field generated by one or more permanent magnets and may move in a linear fashion inside the magnetic field. The motor structure, generally including one or more permanent magnets, may be attached to the frame. When an electric potential or voltage is passed through the voice coil, the wire windings of the voice coil generate an electromagnetic field that interacts with the magnetic field of the one or more permanent magnets. This magnetic interaction results in a force being applied to the voice coil. This force moves the former, causing the cone to vibrate or oscillate. This vibration or oscillation of the cone can produce acoustical energy, such as a sound wave.

Low frequency transducers ("woofer"), midrange frequency transducers ("midrange"), and high frequency transducers ("tweeter") generally produce less acoustical energy as the frequency decreases. Woofers and midranges generally may have a cutoff frequency where the acoustical energy drops about 3 dB below the average energy produced by a given transducer. At frequencies below the cutoff frequency, the acoustical energy produced by the transducer generally decreases rapidly.

A speaker system that includes a transducer, such as a woofer and/or a midrange, may be equipped with a bass-reflex device, such as a vent, port, or passive radiator, to extend the low frequency (bass) response of the system. A bass-reflex device can be tuned or configured to operate at or below the cutoff frequency for the transducer. This resonance of the bass-reflex device may contribute to the total acoustical output of the loudspeaker by extending the low frequency output below that of a sealed system. A loudspeaker with a bass-reflex device may have an extended bass response, thus allowing it to produce lower frequencies than a sealed system with a similar transducer arrangement. A bass-reflex device often is located on the same side of the loudspeaker enclosure as the transducer. The bass-reflex device also may be located on other sides of the loudspeaker enclosure.

A bass-reflex device generally uses the acoustical energy or air pressure generated within an enclosure to extend the low frequency response of the system. When the voice coil of a transducer moves in the magnetic gap, the former may move the cone toward the interior of the enclosure. This movement generates an acoustical wave in the interior of the enclosure. This acoustical wave cannot emanate from the loudspeaker if the enclosure is sealed. The acoustical energy associated with this acoustical wave generated within the enclosure generally is "lost" in the loudspeaker enclosure. A bass-reflex device can use this acoustical energy to resonate below and/or at the cutoff frequency of the transducer.

Some loudspeakers use a port as the bass-reflex device. A port may be a tube-like opening in the speaker enclosure. The port generally is "tuned"—sized and configured—to resonate the air column within the port at a frequency at and/or below the cutoff frequency of the transducer. The air column within the port resonates in response to acoustical energy generated within the enclosure. The resonance frequency of the air in the port may be limited by the available air volume in the speaker enclosure and is often difficult to control.

Other loudspeakers may use a passive radiator as the bass-reflex device. A passive radiator generally is a rigid body mounted within an opening in the speaker enclosure. The rigid body is connected to the speaker enclosure by a surround. The rigid body may be made of paper, polymer, metal, composites, or other noncompliant materials. The surround generally is made of foam rubber, doped cloth, an elastomer, or other pliable material.

A passive radiator translates the air pressure created by the transducer into movement or resonance of the rigid body within the surround. The resonance of the rigid body can generate acoustical energy at a frequency below the cutoff frequency of the transducer. The mass and compliance of the rigid body can control the resonance frequency of the passive radiator. The rigid body may have a conic, flat, or other shape. A passive radiator may look like another "transducer" except without the voice coil, magnet, and related components.

In some applications, such as vehicle and in-wall mounting, there may be little or no available space for a transducer and a passive radiator in the speaker enclosure. Vehicles include automobiles, trucks, boats, trains, airplanes, and the like. In other applications, the design and/or configuration of the loudspeaker enclosure does not permit or limits the use of a passive radiator in the speaker enclosure.

SUMMARY

This invention provides a loudspeaker system with an extended bass or low frequency response. The loudspeaker system integrates a passive radiator with a transducer. An inside perimeter of the passive radiator encloses at least one location on the outside perimeter of the transducer. The loudspeaker system also mechanically isolates the passive radiator and the transducer. The loudspeaker system has a support mechanism that mechanically grounds—cancels, absorbs, and/or translates—vibrations or other forces from the transducer that may interfere with or affect the operation of the passive radiator. The support mechanism also mechanically grounds vibrations or other forces from the passive radiator that may interfere with or affect the operation of the transducer.

A loudspeaker may have a speaker enclosure, a support mechanism, a transducer, and a passive radiator. The speaker enclosure has a back side and a frame. The support mechanism may be connected to the back side of the speaker enclosure. The transducer has an outside perimeter mounted to the support mechanism. The passive radiator has an inside perimeter connected to the support mechanism. The inside perimeter of the passive radiator encloses one or more points on the outside perimeter of the transducer. The passive radiator is connected to the frame.

An enclosure assembly for a loudspeaker may have a speaker enclosure, a support mechanism, and a passive radiator. The speaker enclosure has a back side and a frame. The support mechanism is connected to the back side of the speaker enclosure. The passive radiator has an inside perimeter connected to the support mechanism. The inside perimeter of the passive radiator encloses one or more points on the outside perimeter of the support mechanism. The passive radiator is connected to the frame.

A speaker assembly for a loudspeaker may have a support mechanism, a transducer, and a passive radiator. The transducer has an outside perimeter mounted to the support mechanism. The passive radiator has an inside perimeter connected to the support mechanism. The inside perimeter of the passive radiator encloses one or more points on the outside perimeter of the transducer. The passive radiator is connected to the frame.

In a method for extending the bass response in a loudspeaker, a passive radiator is integrated with a transducer. The passive radiator may be mechanically isolated from the transducer. The passive radiator resonates in response to acoustical energy from the transducer.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
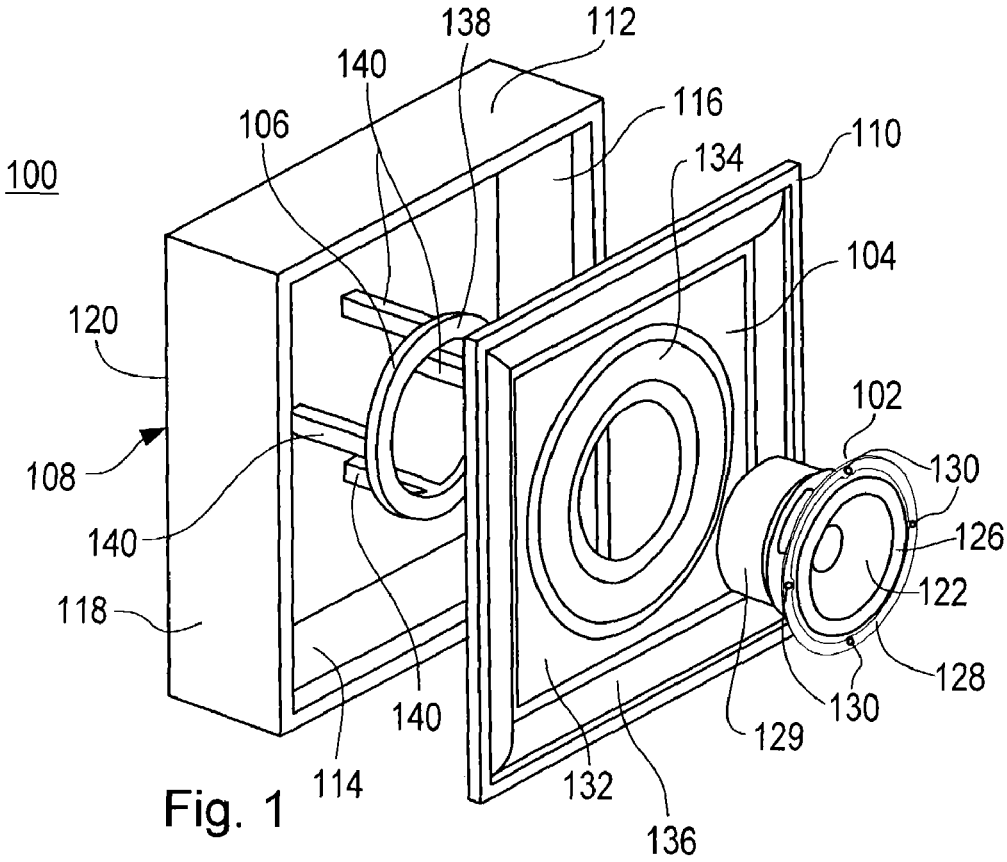
FIG. 1 is an expanded perspective view of a loudspeaker having a passive radiator integrated with a transducer.
Figure 2:
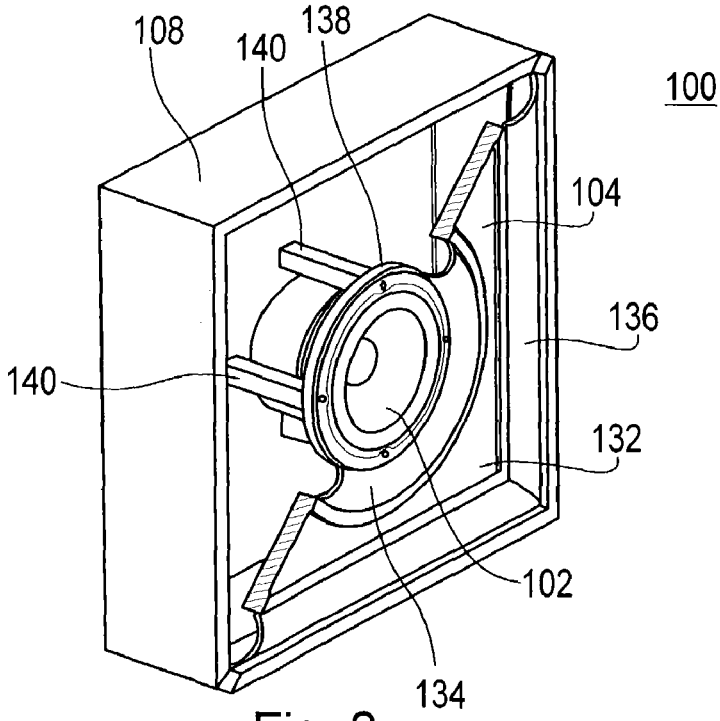
FIG. 2 is a cutaway, perspective view of the loudspeaker shown in FIG. 1 as assembled.
Figure 3:
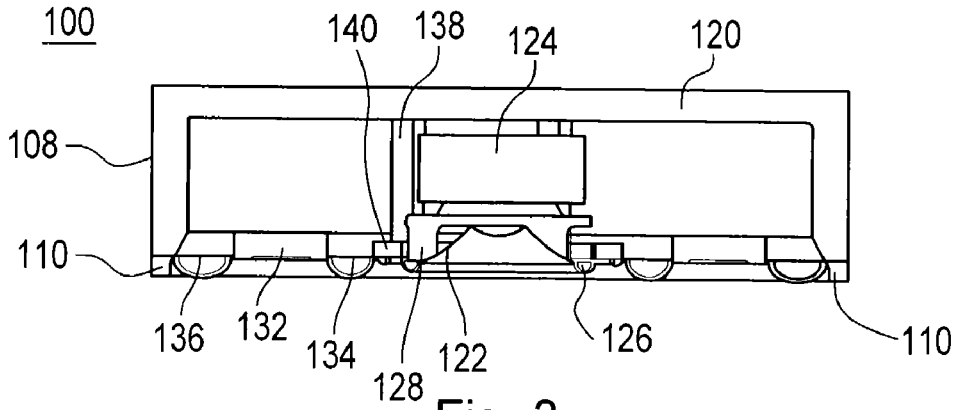
FIG. 3 is a cross-sectional view of the loudspeaker shown in FIG. 1 as assembled.
Figure 4:
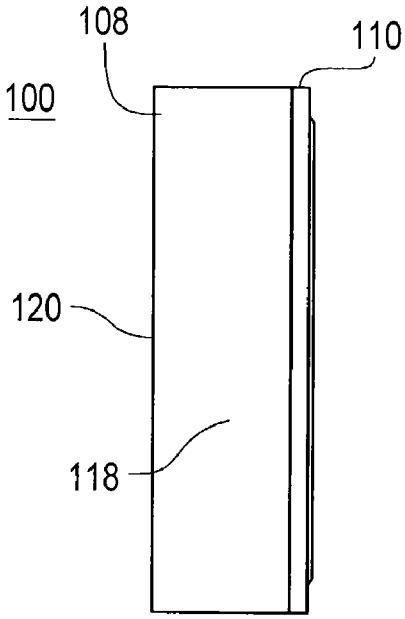
FIG. 4 is a side view of the loudspeaker shown in FIG. 1 as assembled.
Figure 5:
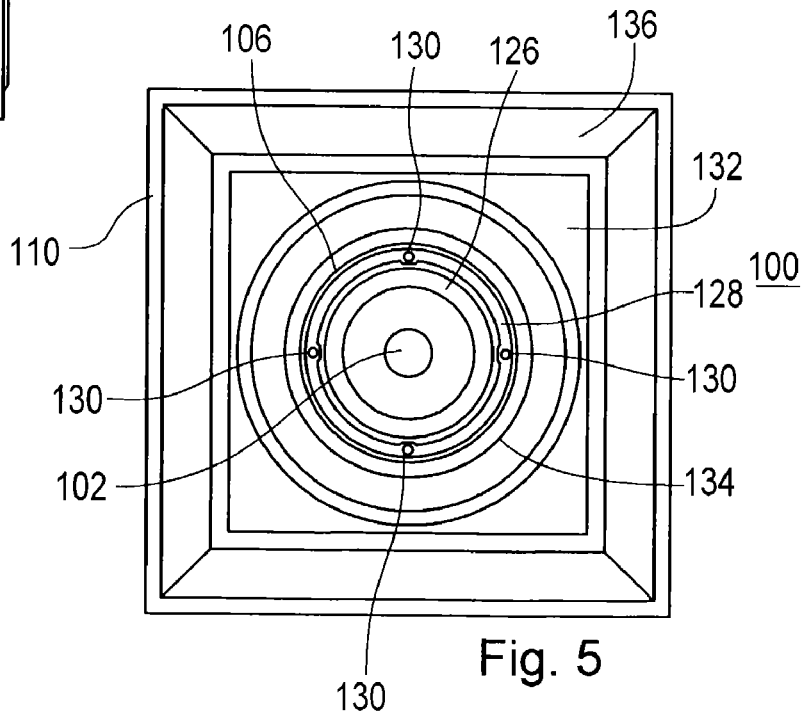
FIG. 5 is a front view of the loudspeaker shown in FIG. 1 as assembled.

FIGS. 1–5 depict views of a loudspeaker 100 with an extended bass response. The loudspeaker 100 has a transducer 102 and a passive radiator 104 mounted on a support mechanism 106 within a speaker enclosure 108. The passive radiator 104 is integrated with the transducer 102. The passive radiator 104 is mechanically isolated from the transducer 102 by the support mechanism 106. The transducer 102 may have a cutoff frequency where the acoustical energy has dropped about 3 dB below the typical energy level of the useful frequency range for the transducer 102. The cutoff frequency may be at frequencies for other levels of the acoustical energy. In operation, the passive radiator 104 resonates in response to the acoustical energy generated within the enclosure. The passive radiator 104 resonates at a resonance frequency below the cutoff frequency of the transducer 102, thus extending its bass response. The loudspeaker 100 may have an amplifier (not shown) and/or a crossover (not shown). The loudspeaker 100 may have other configurations including those with fewer or additional components.

Speaker enclosure 108 has a front frame or baffle 110 connected to a top side 112, a bottom side 114, a right side 116, a left side 118, and a back side 120, which are arranged to form a box shape enclosing the transducer 102. The speaker enclosure 108 provides a substantially sealed enclosure around the transducer 102 and the passive radiator 104. The speaker enclosure 108 may have additional transducers and/or passive radiators. The speaker enclosure 108 may have different types of transducers. The speaker enclosure 108 may have other shapes such as rectangular and oval. A rectangular shape includes a square and other polygons. An oval shape includes a cylinder, an elliptical configuration, and other curvaceous shapes. One or more of the sides may be flat or curvilinear. One or more of the sides may be omitted and may be provided by the environment in which loudspeaker 100 is placed. In an in-wall speaker installation, the wall or wall framing could provide one or more of the sides. In a vehicle speaker installation, the vehicle body or frame could provide one or more of the sides. The speaker enclosure 108 may have other configurations including those with fewer, and additional components.

Support mechanism 106 is positioned in the speaker enclosure 108 at a location to receive the transducer 102 and the passive radiator 104. Support mechanism 106 may be connected to the back side 120 of the speaker enclosure 108 through an attachment device such as an adhesive, screws, and/or bolts. Support mechanism 106 may be connected to the back side 120 of the speaker enclosure 108 through a frictional or other contact caused by the transducer 102 and/or passive radiator 104 applying pressure or biasing the support mechanism 106 against the back side.

Support mechanism 106 has a base 138 connected to support elements or legs 140. The base 138 may be circular, rectangular, or have other shapes. A circular shape includes a circle, oval, ellipse, and the like. A rectangular shape includes a square and other polygons. The base 138 may have an inside perimeter conforming to the shape of the transducer 102. The base 138 may have an outside perimeter conforming to the shape of the passive radiator 104. The support mechanism 106 may have three or four support elements 140. The support elements 140 may be equidistant or at variable distances along the base 138. The support mechanism 106 may have fewer or additional support elements 140. The support mechanism 106 may have a substantially continuous, but perforated or slotted, support element 140 connecting the base 138 to the back side 120 of the speaker enclosure that allows air to exit from behind transducer 102. The support mechanism 106 may have other structural elements connecting the base 138 and/or the support elements 140 to one or more sides of the speaker enclosure 108. The base 138 and support elements 140 may be separate components connected by adhesive, screws, or another attachment device. The base 138 and support elements 140 may be part of the same component. The support mechanism 160 may be made from polymer, metal, composites, or other materials. The support mechanism may have other configurations.

Support mechanism 106 mechanically isolates the transducer 102 and the passive radiator 104 from each other. Mechanical isolation includes the mechanical grounding of part or all of any vibrations or other forces from the transducer 102 that may interfere or affect the operation of the passive radiator 104. Mechanical isolation also includes the mechanical grounding of part or all of any vibrations or other forces from the passive radiator 104 that may interfere or affect the operation of the transducer 102. Interference between the transducer and passive radiator may delay or prevent proper operation, may cause noise or other unrecorded sounds, may alter or silence sound, and may produce other sound reproduction and/or operation anomalies Mechanical grounding includes the absorption, cancellation, and/or translation of vibrations or other forces through the support mechanism 106. Mechanical grounding also includes the absorption, cancellation, and/or translation of vibrations or other forces through the speaker enclosure 108.

Transducer 102 is an electromechanical air moving device that generates acoustical energy from electrical signals. The transducer 102 has a cone 122 with a voice coil wrapped around a former. The voice coil is positioned within the magnetic gap of a magnet 124. When an electric potential is applied to the voice coil, the wire windings generate an electromagnetic field that moves the former. This movement causes the cone to vibrate or oscillate, thus producing acoustical energy. The cone 122 may be made of paper such as a felted paper fiber, a polymer such as polypropylene, a metal such as aluminum, a ceramic, a composite of these or other materials, or another suitable material. The voice coil may have a single or dual coil design. The voice coil may comprise a single coil of about 60 feet of copper ribbon wire. The voice coil may have other configurations including those with different dimensions and materials. The cone 122 is connected to a transducer surround 126, which is connected to a transducer frame 128. The transducer surround 126 is an elastomer like foam rubber, a doped cloth, or other pliable material. The transducer surround 126 does not let air pass through it. The transducer frame 128 extends along the outside of the cone 122 and connects with the magnet 124. The transducer frame 128 has one or more holes 130 disposed along the perimeter adjacent to the transducer surround 126. Transducer 102 is mounted on support mechanism 106 with one or more screws or bolts through the holes 130. The transducer 102 may be mounted on the support mechanism 106 using other attachment mechanisms such as adhesive. The transducer frame 128 and the support mechanism 106 may form a single component. The transducer 102 may provide a partial or full range of acoustical frequencies audible to the human ear. The transducer may provide a specific range of frequencies such as low or midrange frequencies. The low frequencies may be less than about 50 Hz. The midrange frequencies may have a range of 40 Hz to about 2800 Hz. The transducer 102 may have other low and midrange frequencies. The transducer 102 may be a six inch transducer. Other size transducers may be used. The transducer 102 may have a circular or rectangular shape. A rectangular shape includes a square and other polygons. A circular shape includes a cone cylinder, elliptical, and other curvaceous shapes. The transducer 102 may have other configurations including those with fewer or additional components.

Passive radiator 104 has a rigid body or noncompliant surface 132 with an inside surround 134 and an outside surround 136. If rigid body 132 is made from a less rigid material, one or both of surrounds 134 and 136 may be eliminated. The rigid body 132 is connected along an inside perimeter to the inside surround 134, which is connected to the support mechanism 106. The inside perimeter is the edge of the rigid body 132 facing toward the transducer 102. The rigid body 132 also is connected along an outside perimeter to the outside surround 134, which is connected to the frame 110. The outside perimeter is the edge of the rigid body 132 facing away from the transducer 102. The inside perimeter may conform to the shape of the cone 122 and/or transducer frame 128. The outside perimeter may conform to the shape of the frame 110. The outside and inside perimeters may be rectangular and oval. A rectangular shape includes a square and other polygons. An oval shape includes a cylinder, an elliptical configuration, and other curvaceous shapes. The rigid body 132 may have other shapes that do not conform to the frame 110 and/or the transducer frame 128. The rigid body 132 may have shapes that conform and do not conform to other frames having different configurations than either or both of frames 110 and 128. With a six inch transducer, the rigid body 132 may have an outside diameter of about fifteen inches. The rigid body 132 may have other sizes. The rigid body 132 may be made of paper such as a felted paper fiber, a polymer such as polypropylene, a metal such as aluminum, a ceramic, a composite of these or other materials, or other noncompliant materials. Rigid body 132 may have a constant thickness or substantially flat configuration. Rigid body 132 also may have a variable thickness or cone, lens, or similar configuration.

The inside surround 134 conforms to the shape of inside perimeter of the rigid body 132 and the transducer frame 128. The outside surround 136 conforms to the shape of the outside perimeter of the rigid body 132 and the frame 110. The inside and outside surrounds 134 and 136 may have other shapes conforming to the rigid body 132 and frames 110 and 128. The inside and outside surrounds 134 and 136 may be made of an elastomer such as foam rubber, doped cloth, or other pliable material. The inside and outside surrounds 134 and 136 do not let air pass through them, thus a dynamic bellows is formed with the rigid body 132.

The passive radiator 104 may be integrated with the transducer 102. "Integrate" includes the passive radiator 104 partially or completely enclosing the transducer 102 on or about the plane forming the frame 110 of the speaker enclosure. The passive radiator 104 completely encloses transducer 102 when the inside perimeter of the passive radiator 104 surrounds every location or point on the outside perimeter of the cone 122 and/or transducer frame 128. The passive radiator 104 partially encloses transducer 102 when the inside perimeter of the passive radiator 104 surrounds less than every location or point on the outside perimeter of the cone 122 and/or transducer frame. "Integrate" also includes the passive radiator 104 concentric or aligned with the transducer 102 to have a common or parallel axis. If the passive radiator 104 has an oval, elliptical, or other shape having multiple axes, the transducer 102 may be aligned to have a common or parallel axis with one of the axes of the passive radiator 104. The integration of the passive radiator 104 with the transducer 102 can reduce the space requirements of the loudspeaker. In addition, acoustical energy from the passive radiator 104 is radiated from the front of the loudspeaker, thus making loudspeaker 100 suitable for bookshelf speakers, in-wall speakers, automotive speakers, and like applications.

The loudspeaker 100 may be made from one or more assemblies, each having some of the components of the loudspeaker. The support mechanism 106 and the transducer 102 could be one assembly. The support mechanism 106 and the passive radiator 104 could be another assembly. The transducer 102 and passive radiator 104 could be an additional assembly, which could be combined with the support mechanism 106 to make a further assembly. Moreover, the passive radiator 104, support mechanism 106, speaker enclosure 108, and frame 110 may comprise an enclosure assembly that is configured to use different transducers. A user can then select and install the desired transducer into the enclosure assembly. The user could exchange the transducer for a different transducer at a later date. The enclosure assembly may have other components and other configurations.

Figure 6:
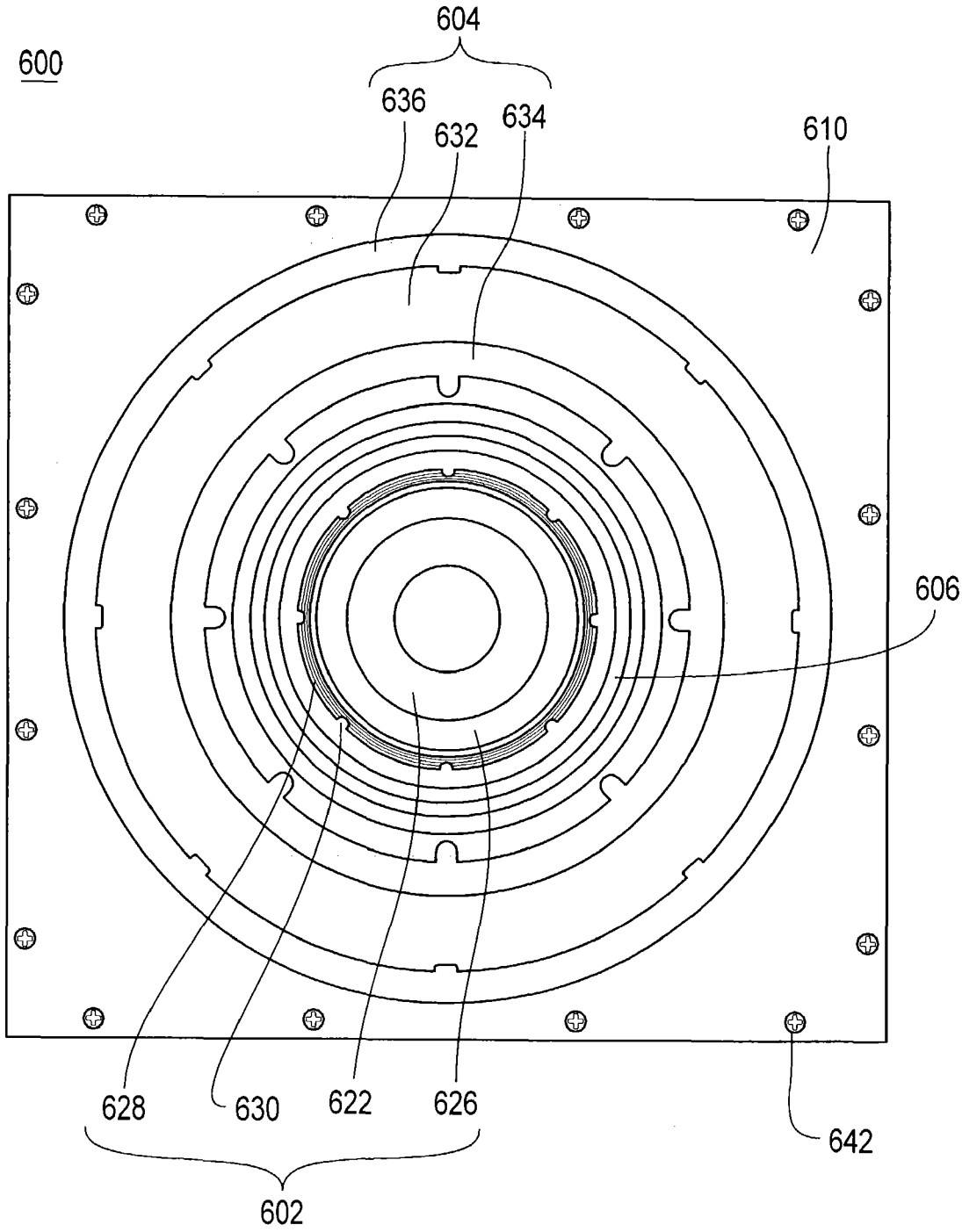
FIG. 6 is a cross-sectional view of another loudspeaker having a passive radiator integrated with a transducer.

FIG. 6 depicts a front view of a loudspeaker 600 with an extended bass response. The loudspeaker 600 has an transducer 602 and a passive radiator 604 mounted on a support mechanism 606 within a frame or baffle 610 of a speaker enclosure. The passive radiator 104 is integrated with the transducer 602 and is mechanically isolated from the transducer 602 by the support mechanism 606. The transducer 602 has a cutoff frequency. In operation, passive radiator 604 resonates at a resonance frequency below the cutoff frequency of the transducer 602 in response to the acoustical energy generated within the enclosure. The loudspeaker 600 may have other configurations including those with fewer or additional components.

Transducer 602 generates acoustical energy from electrical signals. The transducer 602 has a cone 622 with a voice coil positioned within the magnetic gap of a magnet. When an electric potential is applied to the voice coil, the wire windings generate an electromagnetic field that causes the cone to vibrate or oscillate, thus producing acoustical energy, such as a sound wave. The cone 622 is connected to a transducer surround 626, which is connected to a transducer frame 628. The transducer frame 628 has one or more holes 630 disposed along the perimeter adjacent to the transducer surround 626. Transducer 602 is mounted on support mechanism 606 with one or more screws or bolts through the holes 630. The transducer 602 may provide a partial or full range of acoustical frequencies audible to the human ear. The transducer may provide a specific range of frequencies such as low or midrange frequencies. The transducer 602 may have a circular or rectangular shape. The transducer 602 may have other configurations including those with fewer or additional components.

Passive radiator 604 has a rigid body 632 with an inside surround 634 and an outside surround 636. The rigid body 632 is connected along an inside perimeter to the inside surround 634, which is connected to the support mechanism 606. The rigid body 632 also is connected along an outside perimeter to the outside surround 634, which is connected to the frame 610. The inside perimeter of the passive radiator 604 conforms to the circular shape of the outside perimeter of the transducer 602. The outside perimeter of the passive radiator 604 conforms to the circular shape of the inside perimeter of the frame 610.

Figure 7:
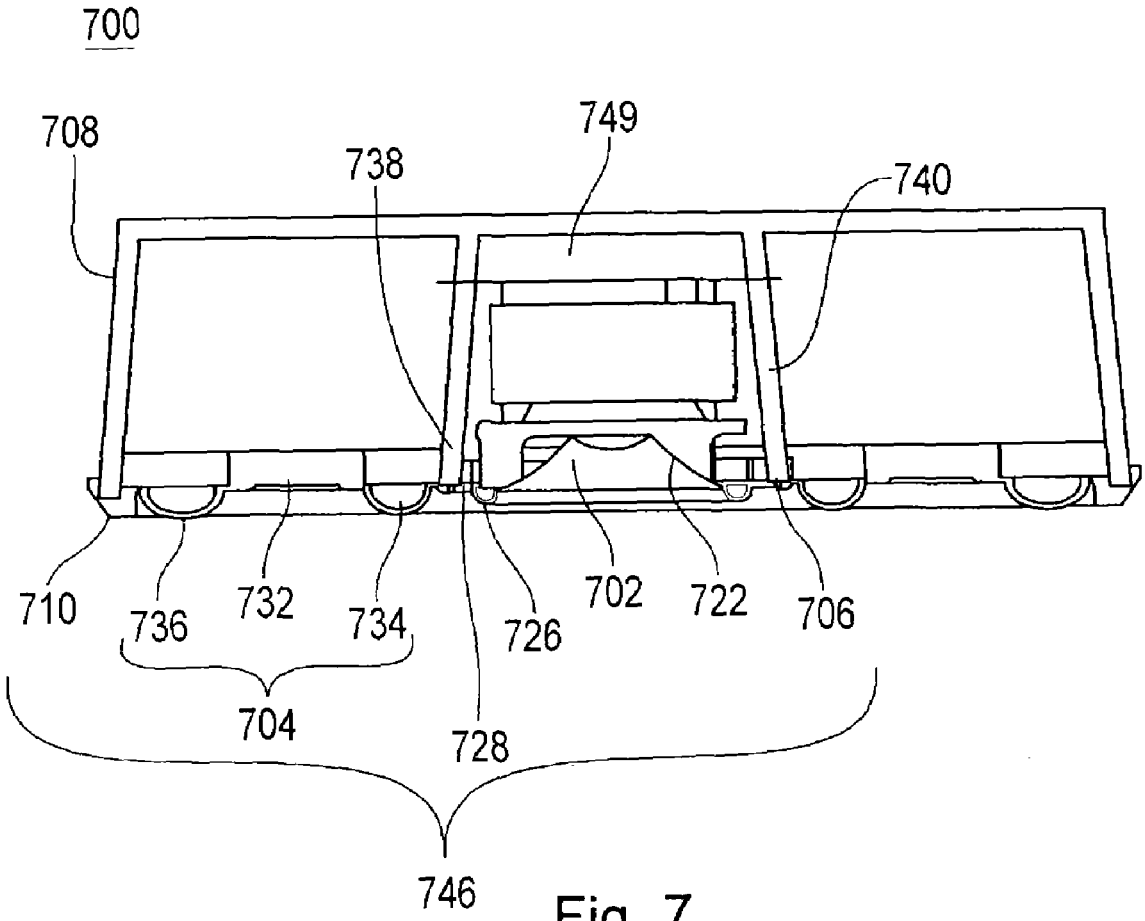
FIG. 7 is a cross-sectional view of an additional loudspeaker having a passive radiator integrated with a transducer.

FIG. 7 depicts a side view of a loudspeaker 700 with an extended bass response. The loudspeaker 700 has speaker assembly 746 and a speaker enclosure 708. The speaker assembly 746 has a transducer 702 and a passive radiator 704 mounted on a support mechanism 706 within a frame 710. The frame 710 of the speaker assembly 746 is connected to the speaker enclosure 708 with adhesive, screws, or another attachment device. The support mechanism 706 is connected to the speaker enclosure 708 with adhesive, screws, another attachment device, or by a frictional or other contact. The passive radiator 704 is integrated with the transducer 702 and is mechanically isolated from the transducer 702 by the support mechanism 706. In operation, passive radiator 704 resonates in response to the acoustical energy generated within the enclosure 708. The passive radiator 704 resonates at a resonance frequency below the cutoff frequency of the transducer 702. Loudspeaker 700 may have other configurations including those with fewer or additional components.

Speaker enclosure 708 may have sides arranged to form a box shape enclosing the transducer 702. The speaker enclosure 708 also may have other shapes such as rectangular and oval. The speaker enclosure 708 can be provided by the environment where loudspeaker 700 is used. In a vehicle, the speaker enclosure 708 may be formed by a door, the trunk, or similar cavity.

Support mechanism 706 has an upper base 738, support elements 740, and a lower base 744. The bases 738 and 744 may be circular, rectangular, or have other shapes. The bases 738 and 744 may have different shapes. The upper base 738 is connected to the support elements 740. The upper base 738 may have an inside perimeter conforming to the shape of the transducer 702. The upper base 738 may have an outside perimeter conforming to the shape of the passive radiator 704. The lower base 744 holds and supports the transducer 702. The lower base 744 may be connected to and may form part of the transducer 702. The lower base 744 may have one or more cross members, connecting the support elements 740 and holding the transducer 702. The support elements 740 may be equidistant or at variable distances along each or both the bases 738 and 744. The support mechanism 706 may have one or more support elements 740. The support mechanism 706 may have other structural elements connecting the upper base 738, the lower base 744, and/or the support elements 740 to one or more sides of the speaker enclosure 708. The lower base 744 may not connect directly to the speaker enclosure 708, but may connect indirectly through one or more structural elements. The bases 738 and 744 and support elements 740 may be separate components or parts of the same component. The support mechanism 706 may have other configurations.

Transducer 702 generates acoustical energy from electrical signals. The transducer 702 has a cone 722 with a voice coil positioned within the magnetic gap of a magnet. When an electric potential is applied to the voice coil, the wire windings generate an electromagnetic field that causes the cone to vibrate or oscillate, thus producing acoustical energy. The cone 722 is connected to a transducer surround 726, which is connected to a transducer frame 728. The transducer frame 728 is mounted on the upper base 738 of the support mechanism 706. The transducer 702 may provide a partial or full range of acoustical frequencies audible to the human ear. The transducer may provide a specific range of frequencies such as low or midrange frequencies. The transducer 702 may have a circular or rectangular shape. The transducer 702 may have other configurations.

Passive radiator 704 has a rigid body 732 with an inside surround 734 and an outside surround 736. The rigid body 732 is connected along an inside perimeter to the inside surround 734, which is connected to the upper base 738 of the support mechanism 706. The rigid body 732 also is connected along an outside perimeter to the outside surround 734, which is connected to the frame 710.

Figure 8:
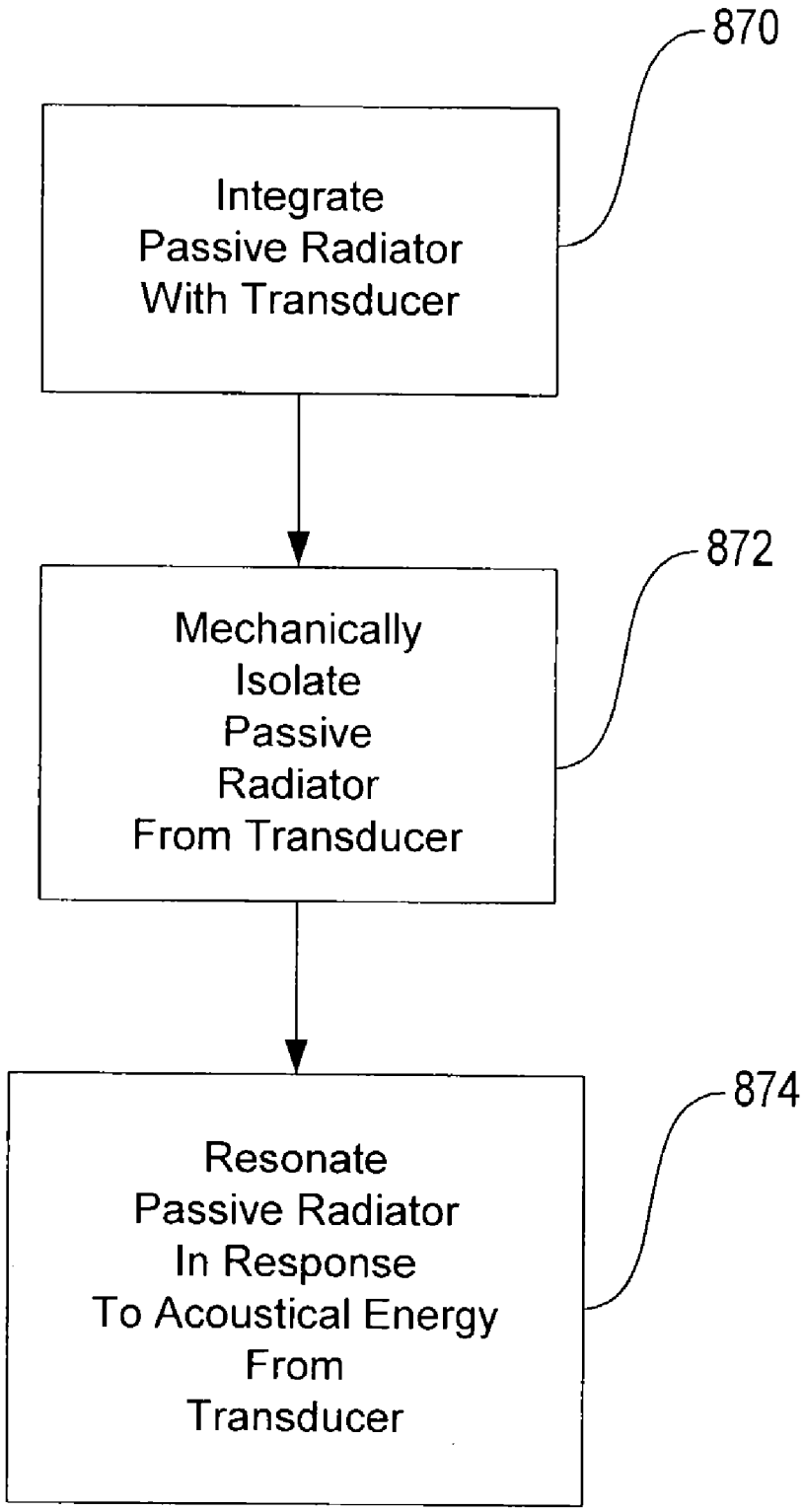
FIG. 8 is flow chart of a method for extending the bass response of a loudspeaker.

FIG. 8 is a flowchart of a method for extending the bass or low frequency response of a loudspeaker. The loudspeaker has a transducer and a passive radiator mounted on a support mechanism within a speaker enclosure as previously discussed. The transducer generates acoustical energy from electrical signals. When an electric potential is applied, the transducer generates acoustical energy. The transducer may provide a broad range or a specific range of acoustical frequencies such as low or midrange frequencies. The passive radiator has a rigid body with inside and outside surrounds. The loudspeaker may have other configurations.

A passive radiator is integrated 870 with a transducer. The passive radiator may partially or completely enclose the transducer as previously discussed. The passive radiator completely encloses the transducer when the inside perimeter of the passive radiator surrounds every location or point on the outside perimeter of the transducer. The passive radiator partially encloses the transducer when the inside perimeter of the passive radiator surrounds less than every location or point on the outside perimeter of the transducer.

The passive radiator is mechanically isolated 872 from the transducer. The passive radiator and transducer are mounted on a support mechanism as previously discussed. The support mechanism mechanically grounds part or all of any vibrations or other forces from the transducer that may interfere or affect the operation of the passive radiator. The support mechanism also mechanically grounds part or all of any vibrations or other forces from the passive radiator that may interfere or affect the operation of the transducer.

The passive radiator resonates 874 in response to acoustical energy from the transducer. The transducer may have a cutoff frequency where the acoustical energy has dropped about 3 dB below the typical energy level of the useful frequency range for the transducer. The cutoff frequency may be at frequencies for other levels of the acoustical energy. The passive radiator resonates in response to acoustical energy within the enclosure and at a resonance frequency below the cutoff frequency of the transducer.

While various embodiments of the invention have been described, it will be apparent to those of ordinary skill in the art that other embodiments and implementations are possible within the scope of the invention. Accordingly, the invention is not to be restricted except in light of the attached claims and their equivalents.

What is claimed is:

1. A loudspeaker, comprising:

a passive radiator integrated with a transducer, where the passive radiator is mechanically isolated from the transducer;

where the transducer has an outside perimeter mounted on a support mechanism, where the support mechanism has three support elements; and where the passive radiator has a rigid body with an inside perimeter connected to an inside surround, the inside surround is connected to the support mechanism, and the inside perimeter of the passive radiator encloses at least one location on the outside perimeter of the transducer.

2. The loudspeaker of claim 1, where the inside perimeter encloses every location on the outside perimeter.

3. The loudspeaker of claim 1, where the transducer is mounted on a support mechanism connected to a speaker enclosure; and where the passive radiator is connected to the support mechanism and to a speaker enclosure.

4. The loudspeaker of claim 1, where the transducer has a transducer surround connected between a cone and a transducer frame; and where the transducer frame is mounted on the support mechanism.

5. The loudspeaker of claim 1, where the transducer is mounted on a support mechanism;

where the passive radiator has a rigid body with an inside perimeter and an outside perimeter, the inside perimeter connected to an inside surround, the outside perimeter connected to an outside surround, where the inside surround is connected to the support mechanism, and where the outside surround is connected to a frame.

6. The loudspeaker of claim 5, where the inside perimeter has a circular shape.

7. The loudspeaker of claim 6, where the transducer has a circular shape.

8. The loudspeaker of claim 5, where the outside perimeter has a circular shape.

9. The loudspeaker of claim 5, where the outside perimeter has a rectangular shape.

10. The loudspeaker of claim 1, where the transducer has a low frequency range.

11. The loudspeaker of claim 10, where the low frequency range is below about 50 Hz.

12. The loudspeaker of claim 1, where the transducer has a midrange frequency range.

13. The loudspeaker of claim 12, where the midrange frequency range is in the range of about 40 Hz to about 2800 Hz.

14. The loudspeaker of claim 1, where the passive radiator resonates at an acoustical frequency below a cutoff frequency for the transducer.

15. A loudspeaker, comprising:

a speaker enclosure having a back side and a frame;

a support mechanism connected to the back side of the speaker enclosure;

a transducer having an outside perimeter mounted to the support mechanism;

a passive radiator having an inside perimeter connected to the support mechanism, where the inside perimeter of the passive radiator encloses at least one point on the outside perimeter of the transducer and the passive radiator is connected to the frame;

where the support mechanism has at least one base connected to three support elements;

where the transducer is connect to the at least one base; and where the three support elements are connected to the back side of the speaker enclosure.

16. The loudspeaker of claim 15, where the speaker enclosure has a rectangular shape.

17. The loudspeaker of claim 15, where the speaker enclosure has an oval shape.

18. The loudspeaker of claim 15, where the at least one base conforms to the shape of the transducer, and where the at least one base conforms to the shape of the passive radiator.

19. The loudspeaker of claim 15, where the support mechanism has four support elements.

20. The loudspeaker of claim 15, where the transducer has a transducer surround connected between a cone and a transducer frame, where the transducer frame is mounted on the support mechanism.

21. The loudspeaker of claim 15, where the transducer has a low frequency range.

22. The loudspeaker of claim 21, where the frequency range is less than about 50 Hz.

23. The loudspeaker of claim 15, where the transducer has a midrange frequency range.

24. The loudspeaker of claim 23, where the frequency range is in the range of about 40 Hz to about 2800 Hz.

25. The loudspeaker of claim 15, where the passive radiator has a rigid body with an inside surround connected along the inside perimeter;

where the inside surround is connected to the support mechanism; and where the passive radiator has an outside surround connected to an outside perimeter of the rigid body, the outside surround connected to a frame.

26. The loudspeaker of claim 15, where the inside perimeter has a circular shape.

27. The loudspeaker of claim 26, where the outside perimeter has a circular shape.

28. The loudspeaker of claim 26, where the outside perimeter has a rectangular shape.

29. The loudspeaker of claim 15, where the inside perimeter of the passive radiator encloses every point on the outside perimeter of the transducer.

30. The loudspeaker of claim 15, where the passive radiator resonates at an acoustical frequency below a cutoff frequency for the transducer.

31. An enclosure assembly for a loudspeaker, comprising:

a speaker enclosure having a back side and a frame;

a support mechanism connected to the back side of the speaker enclosure;

a passive radiator having an inside perimeter connected to the support mechanism, where the inside perimeter of the passive radiator encloses at least one point on the outside perimeter of the support mechanism, the passive radiator connected to the frame;

where the support mechanism has at least one base connected to three support elements;

where the passive radiator is connected to the at least one base; and where the at least one support element is connected to the back side of the speaker enclosure.

32. The enclosure assembly of claim 31, where the speaker enclosure has a rectangular shape.

33. The enclosure assembly of claim 31, where the speaker enclosure has an oval shape.

34. The enclosure assembly of claim 31, where the base conforms to the of the passive radiator.

35. The enclosure assembly of claim 31, where the support mechanism has four support elements.

36. The enclosure assembly of claim 31, where the passive radiator has a rigid body with an inside surround connected along the inside perimeter, where the inside surround is connected to the support mechanism, and where the passive radiator has an outside surround connected to an outside perimeter of the rigid body, where the outside surround is connected to a frame.

37. The enclosure assembly of claim 36, where the inside perimeter has a circular shape.

38. The enclosure assembly of claim 37, where the outside perimeter has a circular shape.

39. The enclosure assembly of claim 37, where the outside perimeter has a rectangular shape.

40. The enclosure assembly of claim 31, where the inside perimeter of the passive radiator encloses every point on the outside perimeter of the support mechanism.

41. A speaker assembly for a loudspeaker, comprising:

a support mechanism;

a transducer having an outside perimeter mounted to the support mechanism;

a passive radiator having an inside perimeter connected to the support mechanism, where the inside perimeter of the passive radiator encloses at least one point on the outside perimeter of the transducer, the passive radiator connected to the frame;

where the support mechanism has three support elements connected to an upper base and a lower base;

where the outer perimeter of the transducer is connect to the upper base; and where the lower base holds the transducer.

42. The speaker assembly of claim 41, where the upper base conforms to the shape of the transducer, and where the upper base conforms to the shape of the passive radiator.

43. The speaker assembly of claim 41, where the support mechanism has four support elements.

44. The speaker assembly of claim 41, where the transducer has a transducer surround connected between a cone and a transducer frame, where the transducer frame is mounted on the support mechanism.

45. The speaker assembly of claim 41, where the transducer has a low frequency range.

46. The speaker assembly of claim 45, where the frequency range is less than about 50 Hz.

47. The speaker assembly of claim 41, where the transducer has a midrange frequency range.

48. The speaker assembly of claim 47, where the frequency range is in the range of about 40 Hz to about 2800 Hz.

49. The speaker assembly of claim 41, where the passive radiator has a rigid body with an inside surround connected along the inside perimeter, where the inside surround is connected to the support mechanism, and where the passive radiator has an outside surround connected to an outside perimeter of the rigid body, where the outside surround is connected to a frame.

50. The speaker assembly of claim 49, where the inside perimeter has a circular shape.

51. The speaker assembly of claim 50, where the outside perimeter has a circular shape.

52. The speaker assembly of claim 50, where the outside perimeter has a rectangular shape.

53. The speaker assembly of claim 41, where the inside perimeter of the passive radiator encloses every point on the outside perimeter of the transducer.

54. The speaker assembly of claim 41, where here the passive radiator resonates at an acoustical frequency below a cutoff frequency for the transducer.

55. A method for extending the bass response in a loudspeaker, comprising:

integrating a passive radiator with a transducer;

mechanically isolating the passive radiator from the transducer;

resonating the passive radiator in response to acoustical energy from the transducer; and translating vibrations from the passive radiator and the transducer through a support mechanism, where the support mechanism has three support elements.

56. The method of claim 55, further comprising enclosing at least one point on the outside perimeter of the transducer in an inside perimeter of the passive radiator connected to the frame.

57. The method of claim 55, further comprising enclosing every point on the outside perimeter of the transducer in an inside perimeter of the passive radiator connected to the frame.

58. The method of claim 55, further comprising resonating the passive radiator at an acoustical frequency below a cutoff frequency for the transducer.

59. The loudspeaker of claim 55, where the transducer has a low frequency range.

60. The loudspeaker of claim 55, where the transducer has a midrange frequency range.

* * * * *